US010028587B1

(12) United States Patent
Kersey

(10) Patent No.: US 10,028,587 B1
(45) Date of Patent: Jul. 24, 2018

(54) COMBINATION BACKPACK AND CHAIR

(71) Applicant: Alton Kersey, Parrish, FL (US)

(72) Inventor: Alton Kersey, Parrish, FL (US)

( * ) Notice: Subject to any disclaimer, the term of this patent is extended or adjusted under 35 U.S.C. 154(b) by 0 days.

(21) Appl. No.: 15/496,088

(22) Filed: Apr. 25, 2017

(51) Int. Cl.
*A47C 13/00* (2006.01)
*A47C 4/52* (2006.01)
*A45F 4/02* (2006.01)
*A45F 3/04* (2006.01)

(52) U.S. Cl.
CPC ..... *A47C 4/52* (2013.01); *A45F 3/04* (2013.01); *A45F 4/02* (2013.01); *A47C 13/00* (2013.01); *A45F 2004/026* (2013.01)

(58) Field of Classification Search
CPC ..... A47C 13/00; A47C 7/62
USPC ..... 297/188.08, 129
See application file for complete search history.

(56) References Cited

U.S. PATENT DOCUMENTS 3,122,397 A * 2/1964 Mintz ..... A47C 4/283 248/164
5,303,975 A 4/1994 Asato
5,381,941 A 1/1995 Brune
5,409,291 A 4/1995 Lamb
5,628,437 A * 5/1997 Kober ..... A01M 31/02 182/187
5,927,798 A * 7/1999 Ahn ..... A45C 15/00 297/129
6,000,752 A * 12/1999 Shyr ..... A47C 4/38 297/129
6,375,258 B1 * 4/2002 Fang ..... A47C 9/10 224/155
6,547,324 B1 4/2003 Ammann, Jr.
6,698,830 B1 3/2004 Gaines
6,997,507 B2 2/2006 Rhee
7,114,773 B2 * 10/2006 Ho ..... A47C 4/24 297/188.08
7,118,172 B1 10/2006 Pattison-Sheets
7,604,288 B1 10/2009 Verhulst
D683,550 S 6/2013 Ammann, Jr.
8,573,454 B2 * 11/2013 Talavera Tolentino ... A45F 4/02 224/153
8,931,832 B2 * 1/2015 Lau ..... A47C 3/18 297/188.08
2005/0099039 A1 * 5/2005 Rhee ..... A47C 4/48 297/129
2008/0012399 A1 * 1/2008 Lin ..... A47C 4/283 297/188.08
2008/0179358 A1 * 7/2008 Redzisz ..... A45F 4/02 224/155

(Continued)

*Primary Examiner* — Timothy J Brindley

(57) ABSTRACT

The combination backpack and chair is a backpack with a collapsible chair integrated thereon. The collapsible chair includes a seat and seat back that are provided along a topmost portion of the backpack. The seat portion of the collapsible chair includes a plurality of telescoping legs that descend downwardly in order to support the collapsible chair on a ground surface. Moreover, when in use as a chair, the backpack is suspended underneath the seat of the collapsible chair. The seat portion includes a plurality of telescoping legs that extend downwardly in order to support the collapsible chair when in use. The collapsible chair is able to collapse when not in use so as to enable use of the backpack. Each of the plurality of telescoping legs intersect through the backpack, and extend below the backpack in order to interface with a supporting surface.

12 Claims, 6 Drawing Sheets

(56) References Cited

U.S. PATENT DOCUMENTS

| | | | | |
|---|---|---|---|---|
| 2011/0221244 | A1* | 9/2011 | Beaty Bishop | A01K 1/033 297/188.08 |
| 2015/0150357 | A1* | 6/2015 | Louren O Ferreira | A45F 4/02 224/155 |
| 2015/0366357 | A1* | 12/2015 | Nelson | A47C 1/14 297/35 |
| 2016/0088950 | A1* | 3/2016 | Gadea | B60N 2/242 297/188.01 |

* cited by examiner

COMBINATION BACKPACK AND CHAIR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of backpacks, more specifically, a backpack that is able to convert itself into a chair, and vice versa.

SUMMARY OF INVENTION

The combination backpack and chair is a backpack with a collapsible chair integrated thereon. The collapsible chair includes a seat and seat back that are provided along a topmost portion of the backpack. The seat portion of the collapsible chair includes a plurality of telescoping legs that descend downwardly in order to support the collapsible chair on a ground surface. Moreover, when in use as a chair, the backpack is suspended underneath the seat of the collapsible chair. The seat portion includes a plurality of telescoping legs that extend downwardly in order to support the collapsible chair when in use. The collapsible chair is able to collapse when not in use so as to enable use of the backpack. Each of the plurality of telescoping legs intersect through the backpack, and extend below the backpack in order to interface with a supporting surface.

It is an object of the invention for a backpack to double as a collapsible chair, and vice versa.

These together with additional objects, features and advantages of the combination backpack and chair will be readily apparent to those of ordinary skill in the art upon reading the following detailed description of the presently preferred, but nonetheless illustrative, embodiments when taken in conjunction with the accompanying drawings.

In this respect, before explaining the current embodiments of the combination backpack and chair in detail, it is to be understood that the combination backpack and chair is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the combination backpack and chair.

It is therefore important that the claims be regarded as including such equivalent construction insofar as they do not depart from the spirit and scope of the combination backpack and chair. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
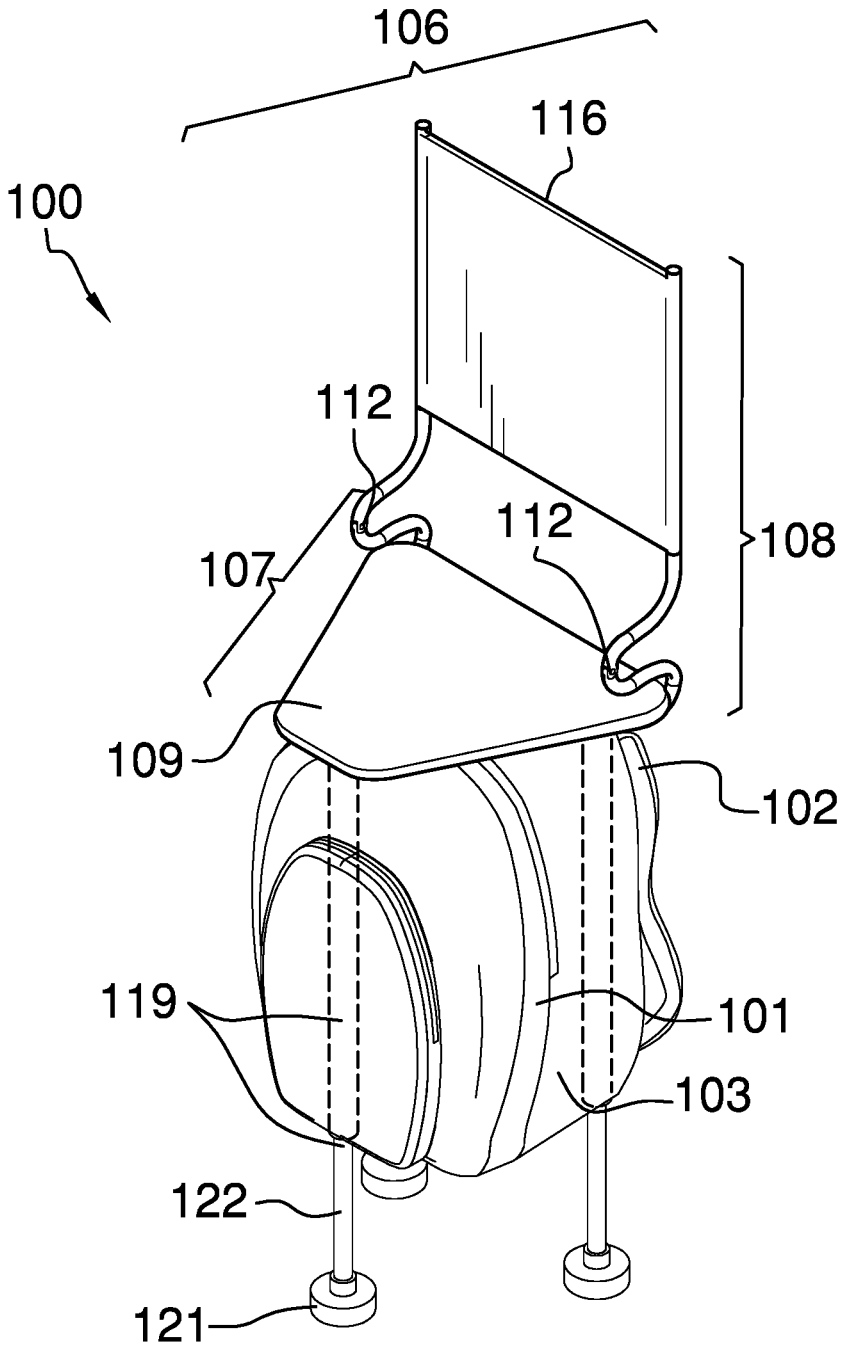
FIG. 1 is a perspective view of an embodiment of the disclosure.
Figure 2:
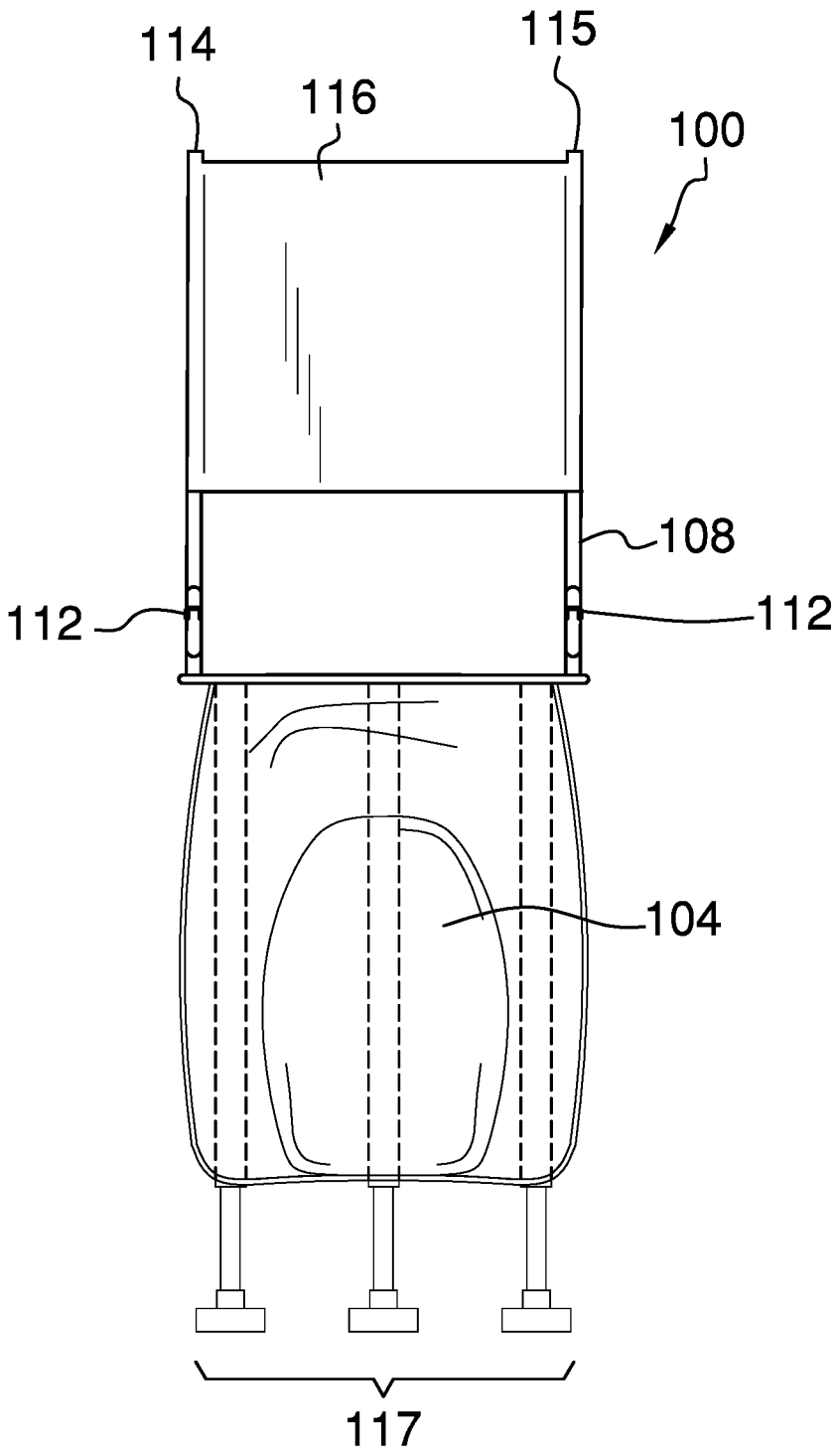
FIG. 2 is a rear view of an embodiment of the disclosure.
Figure 3:
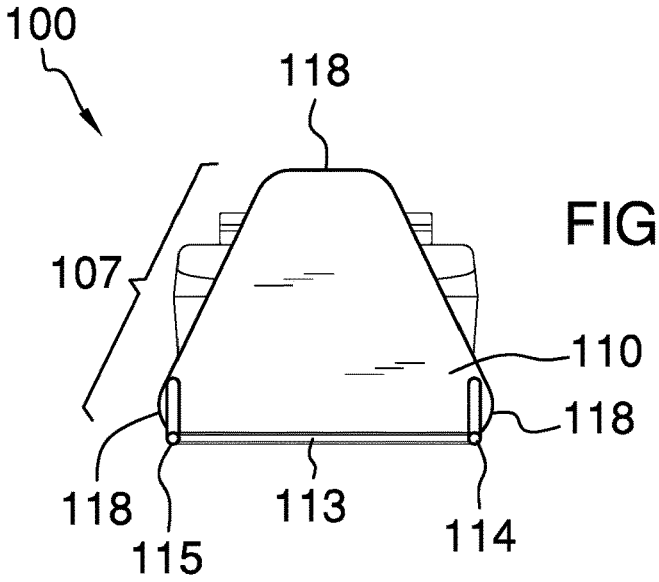
FIG. 3 is a top view of an embodiment of the disclosure.
Figure 4:
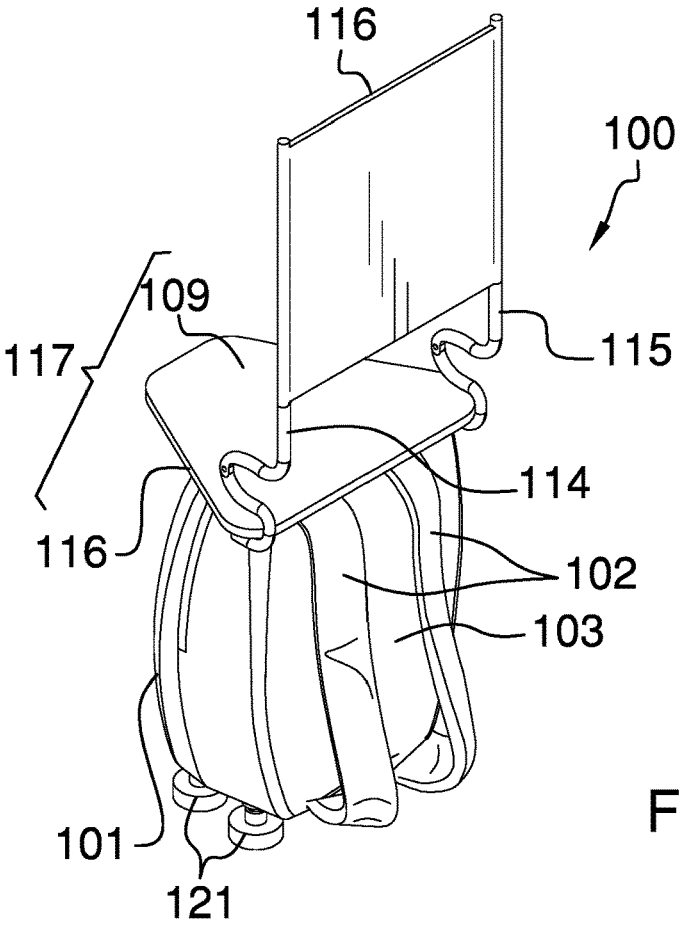
FIG. 4 is a rear, perspective view of an embodiment of the disclosure.
Figure 5:
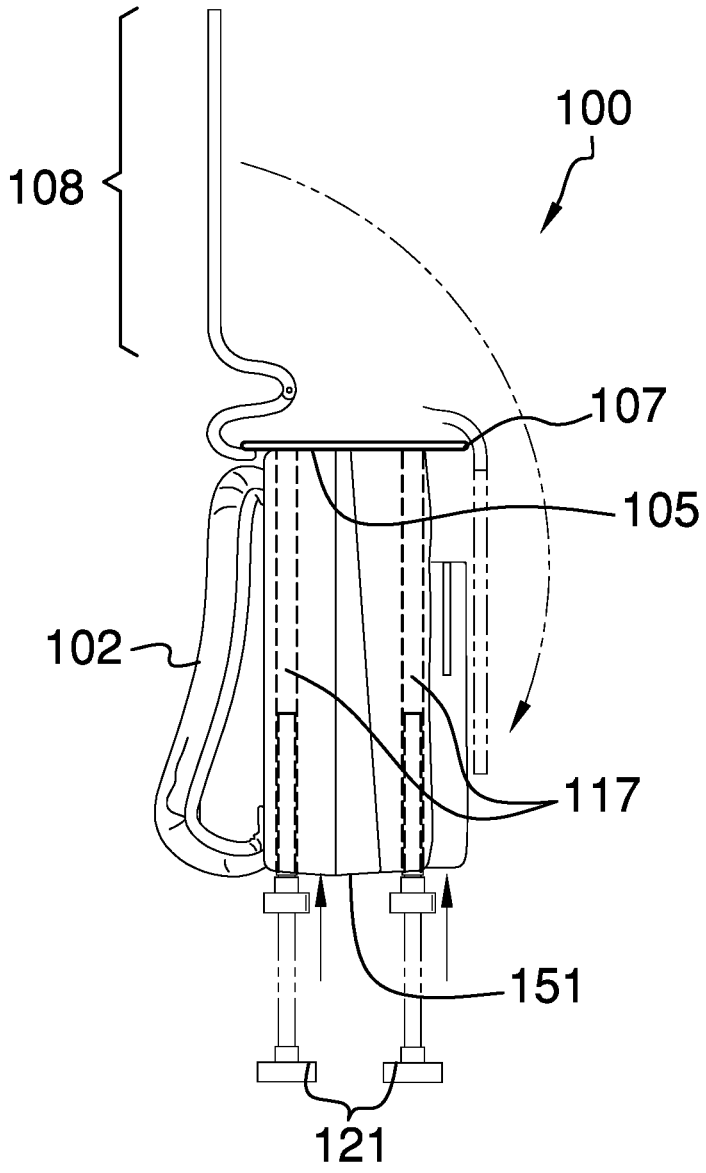
FIG. 5 is a side, detail view of an embodiment of the disclosure.
Figure 6:
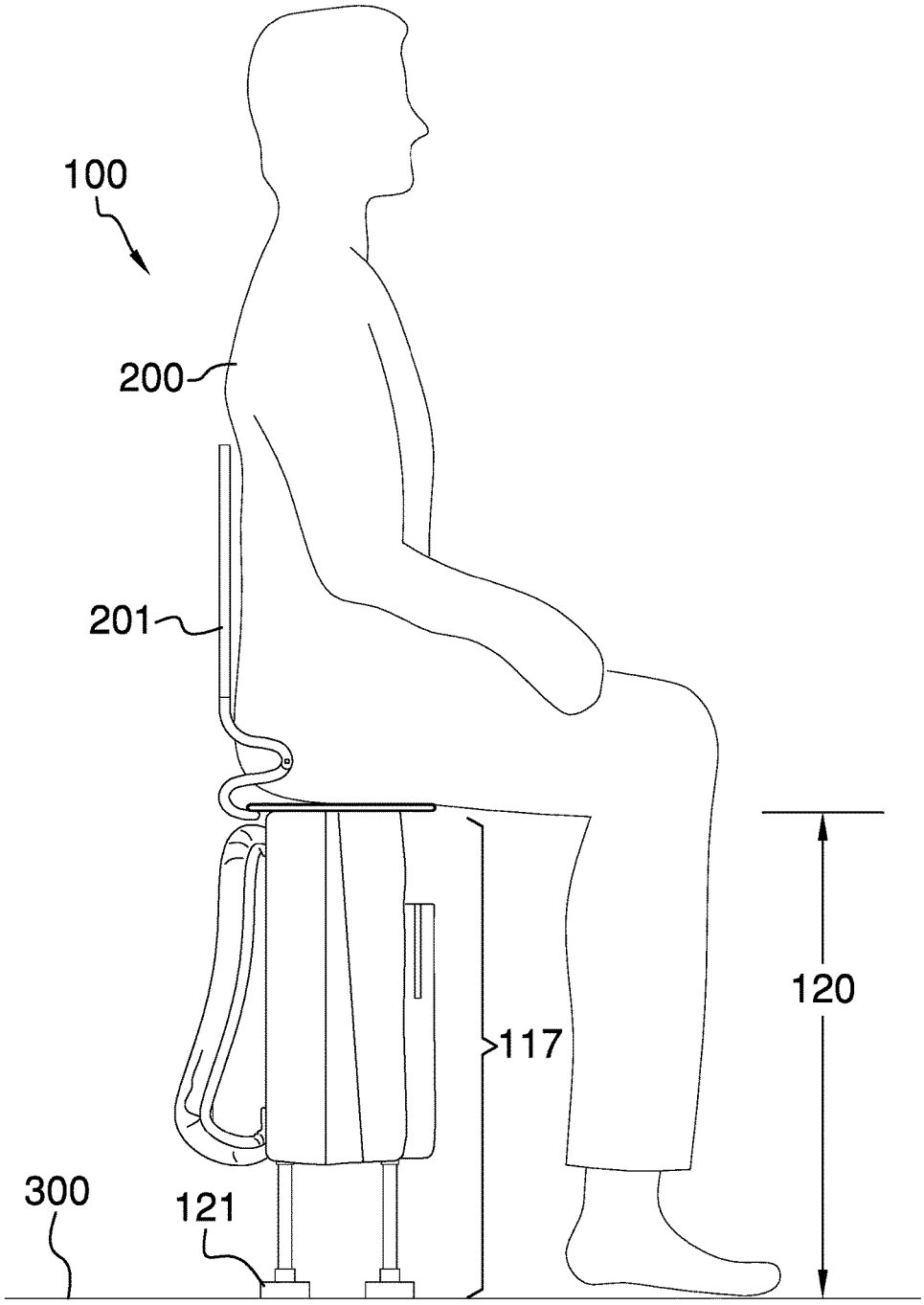
FIG. 6 is a side view of an embodiment of the disclosure in use.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 7.

The combination backpack and chair 100 (hereinafter invention) comprises a backpack 101 with a pair of shoulder straps 102. The pair of shoulder straps 102 is provided on a first backpack surface 103. The first backpack surface 103 is opposite a second backpack surface 104. A top backpack surface 105 extends between the first backpack surface 103 and the second backpack surface 104.

A collapsible chair 106 is attached to the backpack 101. More specifically, the collapsible chair 106 is affixed to the top backpack surface 105 of the backpack 101 so as to provide minimal affect over the use of the backpack 101 as a backpack. The collapsible chair 106 is constructed with a seat portion 107 and a seat back 108.

The seat back 108 is attached to and rotates with respect to the seat portion 107. Moreover a pair of hinges 112 connects the seat back 108 to the seat portion 107. The seat back 108 is able to rotate from a vertical orientation to a horizontal orientation as needed. The seat back 108 is adapted to support a back 201 of an end user 200. Obviously, the seat portion 107 is adapted to support the end user 200 seated thereon. The seat portion 107 is further defined with a top seat surface 109 that is adapted to enable the end user 200 to be seated upon the seat portion 107.

The seat back 108 includes a generally "U" shaped member that is further defined with a horizontal member 113 that spans across to a first vertical armature 114 and a second vertical armature 115. The horizontal member 113 is adapted to interface with a bottom seat surface 110 of the seat portion 107. The first vertical armature 114 is parallel with the second vertical armature 115. Moreover, a flexible back member 116 extends between the first vertical armature 114 and the second vertical armature 115.

The seat portion 107 interfaces with a plurality of telescoping legs 117 that extend downwardly from the bottom seat surface 110 of the seat portion 107. The plurality of telescoping legs 117 extend downwardly and adaptively support the collapsible chair 106 above a ground surface 300. Provided the seat portion 107 resembles a triangular shape, the plurality of telescoping legs 117 are provided adjacent to corners 118 of the bottom surface 116 of the seat portion 107.

The plurality of telescoping legs 117 are each further defined with a plurality of telescoping sections 119 that extend and retract with one another in order to adjust a leg length 120. A foot 121 is provided at a bottommost section 122 of the plurality of telescoping sections 119.

Figure 7:
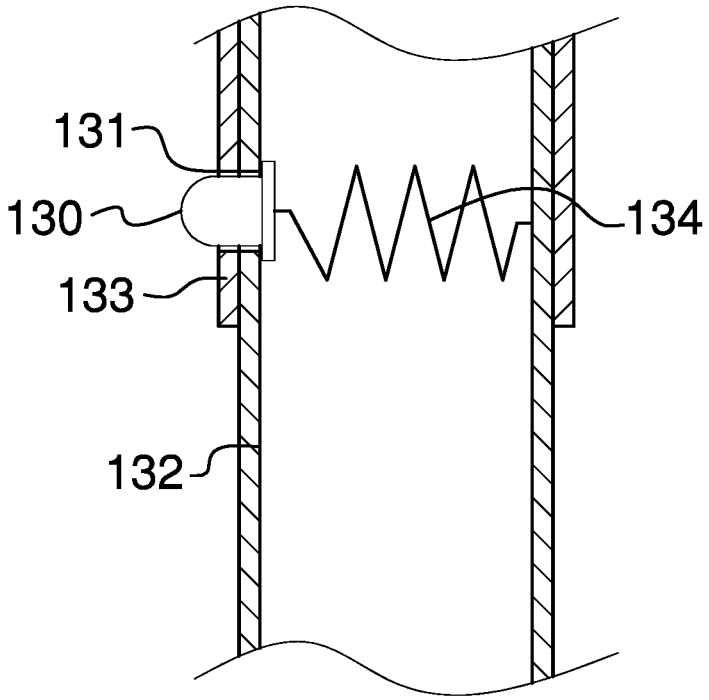
FIG. 7 is a cross-section view of one of the plurality of telescoping legs of an embodiment of the disclosure.

Referring to FIG. 7, a spring-loaded button 130 is used to lock and unlock adjacent ones of the plurality of telescoping sections 119. The spring-loaded button 130 interfaces with a hole 131 to lock and unlock an inner member 132 of the plurality of telescoping sections 119 with respect to an outer member 133 of the plurality of telescoping sections 119. A spring 134 is provided within the inner member 132 in order to bias the spring-loaded button 130 outwardly. Spring-loaded buttons 130 are well known in the art.

The plurality of telescoping legs 117 extend across the top backpack surface 105, through the backpack 101, and out a bottom backpack surface 157. The feet 121 of each of the plurality of telescoping legs 117 stay positioned below the backpack 101.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A combination backpack and chair comprising:

a backpack upon which a collapsible chair is provided;

wherein the backpack is adapted to be used as a backpack, and is suspended underneath the collapsible chair when the collapsible chair is in adaptive use with an end user;

wherein the backpack is further defined with a pair of shoulder straps;

wherein the pair of shoulder straps is provided on a first backpack surface;

wherein the first backpack surface is opposite a second backpack surface;

wherein a top backpack surface of the backpack extends between the first backpack surface and the second backpack surface;

wherein the collapsible chair is affixed to the top backpack surface of the backpack so as to provide minimal affect over the use of the backpack as a backpack;

wherein the collapsible chair is constructed with a seat portion and a seat back;

wherein the seat back is attached to and rotates with respect to the seat portion;

wherein a pair of hinges connects the seat back to the seat portion;

wherein the seat back is able to rotate from a vertical orientation to a horizontal orientation as needed;

wherein the seat back is adapted to support a back of an end user;

wherein the seat portion is adapted to support the end user seated thereon;

wherein the seat portion is further defined with a top seat surface that is adapted to enable the end user to be seated upon the seat portion;

wherein the seat back includes a generally "U" shaped member that is further defined with a horizontal member that spans across to a first vertical armature and a second vertical armature;

wherein the horizontal member is adapted to interface with a bottom seat surface of the seat portion;

wherein the first vertical armature is parallel with the second vertical armature.

2. The combination backpack and chair according to claim 1 wherein a flexible back member extends between the first vertical armature and the second vertical armature; wherein the end user is adapted to interface with the flexible back member when seated on the collapsible chair.

3. The combination backpack and chair according to claim 2 wherein the seat portion interfaces with a plurality of telescoping legs that extend downwardly from the bottom seat surface of the seat portion.

4. The combination backpack and chair according to claim 3 wherein the plurality of telescoping legs extend downwardly and adaptively support the collapsible chair above a ground surface.

5. The combination backpack and chair according to claim 4 wherein the seat portion resembles a triangular shape; wherein the plurality of telescoping legs are provided adjacent to corners of the bottom surface of the seat portion.

6. The combination backpack and chair according to claim 5 wherein the plurality of telescoping legs are each further defined with a plurality of telescoping sections that extend and retract with one another in order to adjust a leg length.

7. The combination backpack and chair according to claim 6 wherein a foot is provided at a bottommost section of the plurality of telescoping sections.

8. The combination backpack and chair according to claim 7 wherein a spring-loaded button is used to lock and unlock adjacent ones of the plurality of telescoping sections.

9. The combination backpack and chair according to claim 8 wherein the spring-loaded button interfaces with a hole to lock and unlock an inner member of the plurality of telescoping sections with respect to an outer member of the plurality of telescoping sections.

10. The combination backpack and chair according to claim 9 wherein a spring is provided within the inner member in order to bias the spring-loaded button outwardly.

11. The combination backpack and chair according to claim 10 wherein the plurality of telescoping legs extend across the top backpack surface, through the backpack, and out a bottom backpack surface.

12. The combination backpack and chair according to claim 11 wherein the feet of each of the plurality of telescoping legs stay positioned below the backpack.

* * * * *